US008349138B2

(12) United States Patent
Mausser et al.

(10) Patent No.: US 8,349,138 B2
(45) Date of Patent: Jan. 8, 2013

(54) DEVICE FOR TREATING A PULP WEB IN AN EXTENDED NIP PRESSING UNIT

(75) Inventors: Wilhelm Mausser, Graz (AT); Andreas Anzel, Graz (AT); Harald Weigant, Stattegg (AT); David V. Lange, Beloit, WI (US)

(73) Assignee: Andritz AG, Graz (AT)

( * ) Notice: Subject to any disclaimer, the term of this patent is extended or adjusted under 35 U.S.C. 154(b) by 104 days.

(21) Appl. No.: 12/800,547

(22) Filed: May 18, 2010

(65) Prior Publication Data

US 2010/0300635 A1 Dec. 2, 2010

(30) Foreign Application Priority Data

May 19, 2009 (AT) ..... A 781/2009

(51) Int. Cl.
*D21F 3/04* (2006.01)
*D21F 3/02* (2006.01)

(52) U.S. Cl. ..... 162/358.3; 162/358.2; 162/358.4; 162/361; 162/901; 100/153

(58) Field of Classification Search .... 162/358.1–358.5, 162/360.2, 360.3, 362, 363, 900–902; 100/161, 100/162 R, 137–144, 151, 153, 176, 193
See application file for complete search history.

(56) References Cited

U.S. PATENT DOCUMENTS 4,662,992 A * 5/1987 Mirsberger ..... 162/203
4,988,410 A * 1/1991 Meinecke et al. ..... 162/360.2
5,043,046 A * 8/1991 Laapotti ..... 162/358.3
5,120,400 A * 6/1992 Laapotti ..... 162/206
5,256,257 A * 10/1993 Schiel ..... 162/360.3
5,389,205 A * 2/1995 Pajula et al. ..... 162/205
5,522,959 A * 6/1996 Ilmarinen ..... 162/205
5,611,893 A 3/1997 Pajula et al. ..... 162/360.2
5,639,351 A * 6/1997 Ilmarinen ..... 162/205
5,681,431 A 10/1997 Steiner ..... 162/360.2
5,705,034 A * 1/1998 Schiel ..... 162/205
5,810,974 A * 9/1998 Laapotti ..... 162/358.5
6,136,154 A * 10/2000 Kotitschke et al. ..... 162/360.3
6,197,156 B1 * 3/2001 Ilmarinen ..... 162/205
6,221,214 B1 * 4/2001 Kotitschke et al. ..... 162/210
6,261,416 B1 * 7/2001 Esslinger et al. ..... 162/205
6,514,385 B2 * 2/2003 Scherb et al. ..... 162/205
6,835,285 B2 * 12/2004 Aho ..... 162/358.3
2003/0024678 A1 * 2/2003 Aho ..... 162/358.5
2005/0126031 A1 * 6/2005 Herman et al. ..... 34/114
2008/0257514 A1 * 10/2008 Scherb et al. ..... 162/281

(Continued)

FOREIGN PATENT DOCUMENTS

DE 37 42 848 A1 6/1989

(Continued)

*Primary Examiner* — Jose A Fortuna
(74) *Attorney, Agent, or Firm* — Alix, Yale & Ristas, LLP

(57) ABSTRACT

A process and apparatus for treating a pulp web (9) in a paper or board machine in a pressing unit (29) with one press roll (24) that has a rotating press shell (25) and one opposing roll (23), where the pulp web (9) is dewatered in an extended press nip (26) between the opposing roll (23) and the pressing shell (25) of the press roll (24). The pulp web (9) is carried on the rotating pressing shell (25) of the press roll (24) to a transfer zone (30), where the pulp web (9) is passed from the pressing shell (25) onto a transfer element (31, 27) after leaving the extended press nip (26).

10 Claims, 6 Drawing Sheets

U.S. PATENT DOCUMENTS

| | | | | |
|---|---|---|---|---|
| 2008/0308240 | A1 * | 12/2008 | Biagiotti | 162/117 |
| 2010/0186913 | A1 * | 7/2010 | Super et al. | 162/111 |
| 2010/0300635 | A1 * | 12/2010 | Mausser et al. | 162/199 |
| 2012/0055644 | A1 * | 3/2012 | Mausser et al. | 162/210 |

FOREIGN PATENT DOCUMENTS

| | | | | |
|---|---|---|---|---|
| DE | 196 03 640 | A1 | | 8/1996 |
| DE | 196 54 325 | A1 | | 6/1998 |
| DE | 100 24 294 | A1 | | 11/2001 |
| DE | 102 33 920 | A1 | | 2/2004 |
| EP | 1 397 553 | B1 | | 5/2002 |
| EP | 1 075 567 | B1 | | 8/2003 |
| EP | 2264243 | A1 | * | 12/2010 |
| JP | 03152290 | A | * | 6/1991 |
| WO | WO 95/16821 | | | 6/1995 |
| WO | WO 98/32917 | | | 7/1998 |

* cited by examiner

DEVICE FOR TREATING A PULP WEB IN AN EXTENDED NIP PRESSING UNIT

BACKGROUND

The invention relates to a process and apparatus for treating a pulp web in a paper or board machine in a long-nip pressing unit with one press roll that has a rotating pressing shell and one opposing roll, where the pulp web is dewatered in an extended press nip between the opposing roll and the pressing shell of the press roll.

In conventional paper and tissue production processes, mechanical dewatering of a pulp web before thermal drying takes place by direct pressing of the pulp web onto a drying cylinder (Yankee cylinder). A production process of this kind is described in DE 102 33 920 A1. In these paper and tissue machines, however, mechanical pressing and the line load that can be achieved is limited by the pressure because it is applied to the Yankee drying cylinder. By means of a preceding pressing stage, as described in EP 1 075 567 B1 for example, mechanical dewatering is performed in a press unit that is independent of the Yankee cylinder. Here, it is possible to set optimum pressing conditions because the pressure is no longer applied to the drying cylinder and thus is not limited by the load limits of the drying cylinder. Mechanical dewatering can be improved substantially by this preceding pressing stage, which is preferably carried out in a ling-nip pressing unit, particularly a shoe press. The effort involve in thermal drying is reduced, thus leading to energy savings.

EP 1 397 553 B1 describes a process to produce a pulp web, where the pulp web is dewatered by means of a shoe press before being transferred to a through-air drum (TAD) for the thermal drying.

In conventional processes for producing board, it is state of the art to use one or several separate pressing stages for mechanical dewatering before thermal drying. A press arrangement of this kind is described, for example, in EP 0 954 634 B1. Here, too, the pressing steps are often carried out with one or more extended-nip pressing units, such as shoe presses.

In order to be dewatered in an extended-nip pressing unit, such as a shoe press, the pulp web is fed on a felt through a press nip, which is formed by a shoe press roll with a rotating pressing shell and an opposing roll. After the extended press nip, the felt is separated from the pulp web as rapidly as possible. The pulp web then continues on a fabric that was also fed through the extended press nip or is carried onward by the opposing roll.

The pressing shell of extended-nip pressing units has direct contact with a fabric in the extended press nip in conventional plants and is used solely for mechanical dewatering.

Onward transport of the pulp web is always performed by other structural elements.

SUMMARY

The present disclosure is directed to a process for treating a pulp web, where dewatering and onward transport of the pulp web take place without any web transfer in between the two. In addition, a simpler and more compact set-up for the press arrangement is disclosed for a paper or board machine.

In the process according to the invention, the pulp web is carried on the rotating pressing shell of the press roll to a transfer zone, where it is passed from the pressing shell onto a transfer element after leaving the extended press nip. The rotating pressing shell thus not only fulfils its function as a pressing element, but serves at the same time as a means of transporting the pulp web onwards after mechanical dewatering.

In some embodiments, there is no need for a transfer fabric that runs through the extended press nip together with the felt. In addition, the pulp web adheres very well to the flexible pressing shell as a result of the pressing operation. When the pulp web is transferred from the pressing shell to a transfer element, other benefits arise that are also explained below.

It is favorable if the pulp web is passed from the pressing shell to a transfer fabric in the transfer zone. When this takes place, the transfer fabric may be wrapped partly around the pressing shell in the transfer zone. This results in an extended transfer zone that ensures reliable web transfer.

Transfer of the pulp web to the transfer element can be assisted by a roll, to which suction is applied.

In a further embodiment of the invention, the pressing shell of the pressing roll is stabilized by the overpressure prevailing inside the press roll. This stabilizing process ensures that the pressing shell runs evenly, which also has a positive effect on the service life of the pressing shell.

It makes sense to carry the pulp web through the extended press nip on a felt. The felt then absorbs the moisture from the pulp web in the extended press nip. In order to avoid re-wetting, the felt should be separated from the pulp web immediately after the extended press nip.

It is an advantage if the felt on which the pulp web is carried through the extended press nip has a three-dimensional structure, where the pulp web is pressed into this three-dimensional structure in the extended press nip. Thus, the pulp web can give way into the three-dimensional structure of the felt during the pressing process. As a result, the pressure is applied to single points and not over an entire area, thus making is possible to achieve better quality properties than in conventional tissue, for example.

When the pulp web is transferred from the pressing shell to the transfer element with a speed differential between pressing shell and transfer element, a further process step for the pulp web can be performed at the same time. If the transfer element in the transfer zone moves at a lower relative speed than the pressing shell, the pulp web is creped as it is transferred from the pressing shell to the transfer element. It is also feasible for the transfer element to have a higher relative speed than the pressing shell, allowing tensile force to be applied to the pulp web in the running direction of the web.

In a favorable embodiment of the invention, the pressing shell is cleaned by a cleaning device after transfer of the pulp web to the transfer element. This guarantees that there are no contaminants or residual pulp web particles adhering to the pressing shell the next time it passes through the press nip.

In a further favorable embodiment of the process, a boundary surface adhesion mixture is applied to the surface of the pressing shell before the pressing shell passes through the extended press nip. This can be applied by means of a spray bar, for example, that sprays the boundary surface adhesion mixture onto the pressing shell. As a result of this process stage, surface adhesion of the pulp web to the pressing shell can be regulated effectively.

Dewatering the pulp web in the press nip can also be improved (change in viscosity) by heating the pulp web with the aid of a steam blow box located in front of the extended press nip.

The invention also relates to a press arrangement of a paper or board machine with which the process according to the invention is performed. In the press arrangement according to the invention, the pulp web is fed through an extended press nip of a pressing unit, where the pressing unit contains a press roll with a rotating pressing shell and an opposing roll. After leaving the extended press nip, the pulp web is carried on the pressing shell of the pressing roll to a transfer element that supports the pulp web. It is advantageous if the press roll concerned is a shoe press roll.

It is an advantage if the transfer element is a transfer fabric, which can be either structured or unstructured. In the transfer zone the transfer fabric can be wrapped partly round the pressing shell. A permeable transfer fabric also has the advantage that transfer of the pulp web from the pressing shell to the transfer fabric is assisted by means of suction devices that hold the pulp web by suction applied through the transfer fabric.

Good web transfer can also be achieved if there is an extended transfer nip for web transfer between the transfer element and the press roll. If the length of the extended transfer nip between pressing shell and transfer element is adjustable, web transfer can be optimized according to web type and machine speed. This extended transfer nip, to which suction can preferably also be applied, extends the transfer zone, which can also result in reliable web transfer.

It is particularly advantageous if the pulp web is carried through the extended press nip on a felt, where the position of a felt roll round which the felt is deflected after the extended press nip can be set in such a way that the contact area or contact length after the extended press nip between the felt and the pulp web can be adjusted as a result.

Enlarging this contact area will result in the felt running on the pulp web for a little longer, which favors the pulp web running on the pressing shell and its transfer to the pressing shell. On the other hand, by reducing the contact area between the felt and the pulp web, it is possible to separate the felt from the pulp web particularly quickly after the press nip and thus prevent or minimize re-wetting. In addition, the largest possible contact area can be created first of all for transfer of a web tail so that the web tail runs securely on the pressing shell. After threading in the pulp web and widening it over the width of the press, this contact area can be reduced again in order to keep re-wetting of the pulp web to a minimum.

BRIEF DESCRIPTION OF THE DRAWING

Embodiments of the invention are described with reference to the drawing, where.

DETAILED DESCRIPTION

Figure 1:
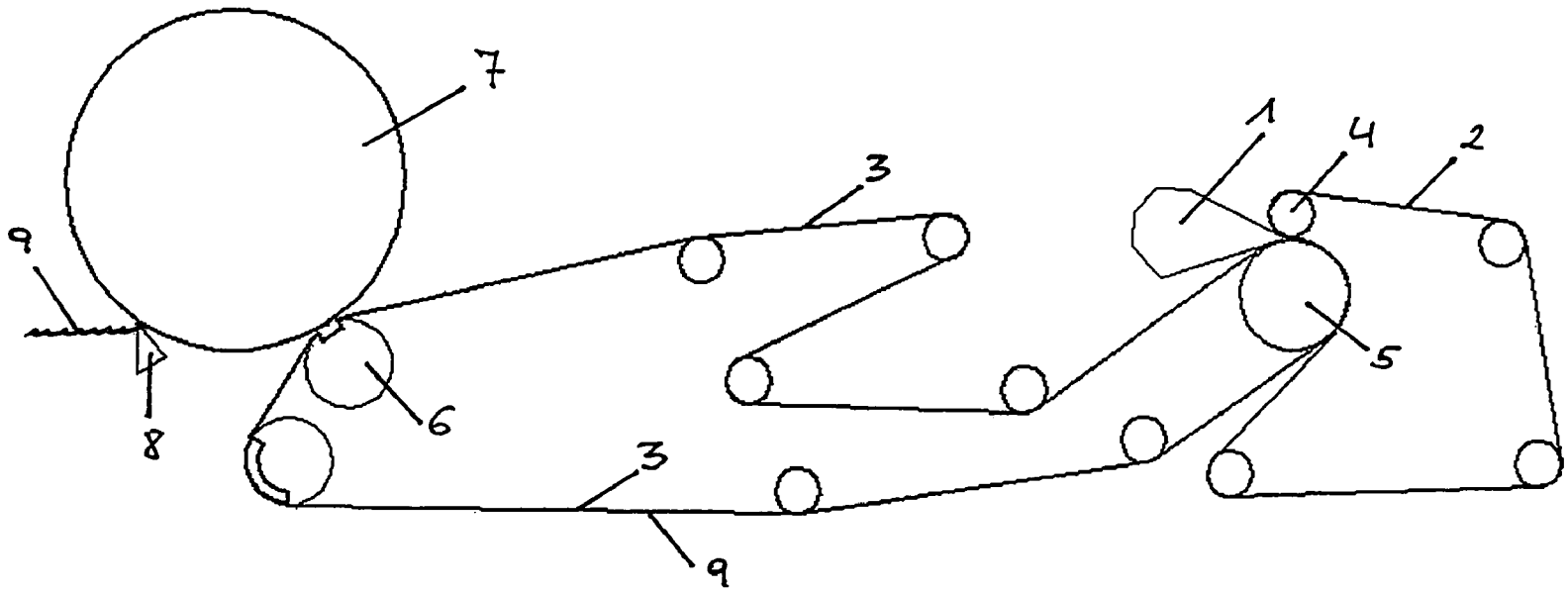
FIG. 1 shows a state-of-the-art paper machine with shoe press technology for production of tissue paper.

In the following description, identical reference numerals in the individual figures refer to identical components.

FIG. 1 shows a conventional tissue machine with shoe press technology. The pulp suspension is fed to the forming unit through a headbox 1 and exits from the headbox 1 between a breast roll 4 and a forming roll 5. An outer fabric 2 is wrapped round the breast roll 4. In the forming unit, the pulp suspension is dewatered far enough for a pulp web 9 to form on the fabric 3. The fabric 3 is preferably a felt that carries the pulp web 9 to a shoe press roll 6. An extended press nip in which the pulp web is dewatered mechanically and transferred to the Yankee cylinder 7 is formed between the shoe press roll 6 and the Yankee cylinder 7. Thermal drying of the pulp web 9 takes place on the Yankee 7. A doctor 8 detaches the dry pulp web 9 from the Yankee cylinder 7. Due to direct pressing of the pulp web 9 onto the Yankee cylinder 7, mechanical dewatering is limited because the shoe press roll 6 cannot be pressed onto the Yankee cylinder 7 at any desired force for reasons of stability. The maximum line load is generally limited to 170 kN/m.

As a result of the press arrangement according to the invention, mechanical dewatering of the pulp web 9 can be increased substantially compared with the press arrangement in FIG. 1.

Figure 2:
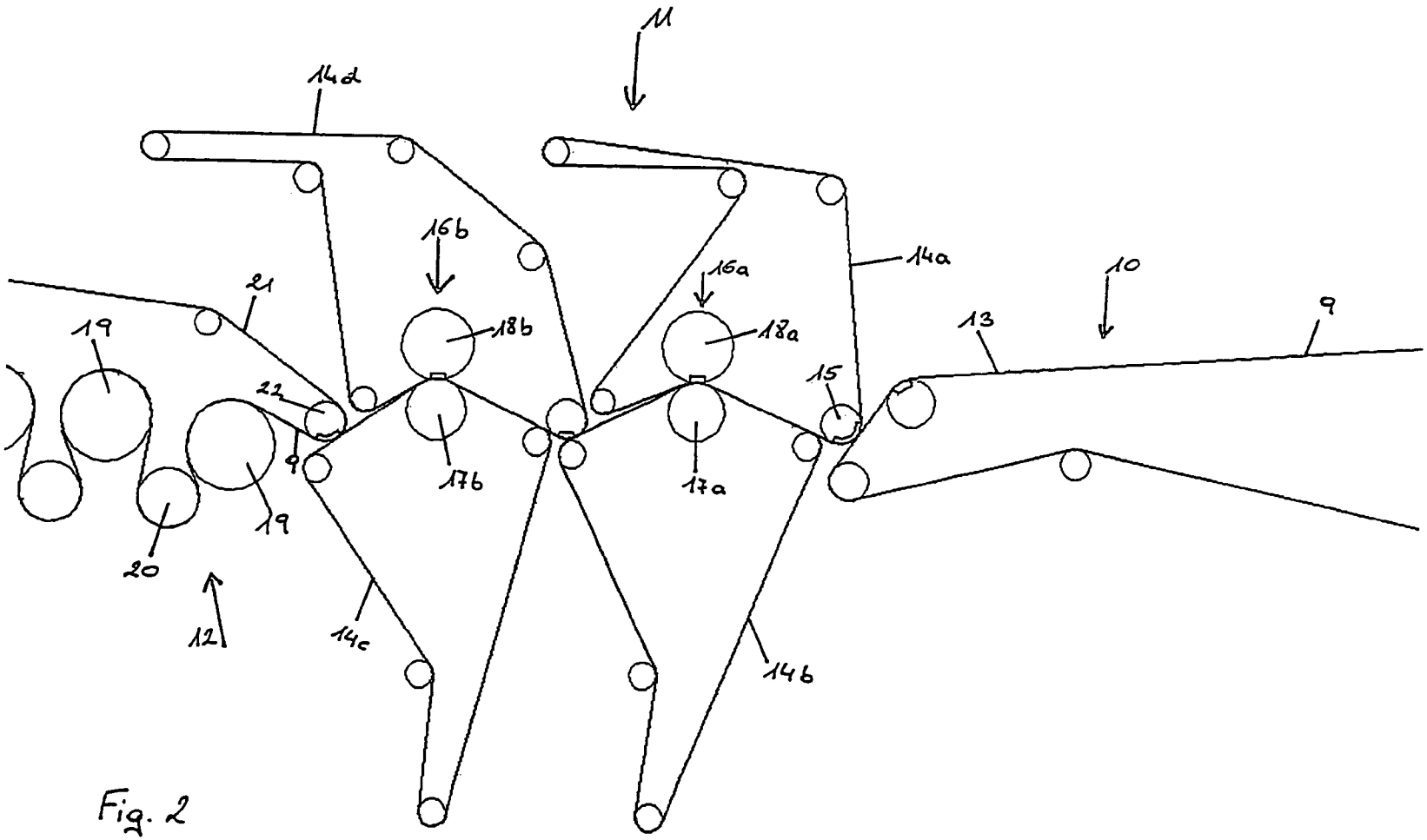
FIG. 2 shows a state-of-the-art press section of a board machine.

FIG. 2 shows a schematic view of a press section 11 of a state-of-the-art board machine. The press section 11 here is arranged after a wet section 10 and before a dryer section 12. The pulp web 9 is transferred from the wet section 10 to the press section 11 by the wire 13. Web transfer to the pressing felt 14*a* is assisted by the transfer roll 15, to which suction is applied. In the press section 11, the pulp web 9 is dewatered mechanically by the two shoe presses 16*a* and 16*b*. The shoe presses 16*a*, 16*b* each consist of a shoe press roll 18*a*, 18*b* and an opposing roll 17*a*, 17*b*.

An extended press nip in which the pulp web 9 is dewatered mechanically is formed in each case between the shoe press rolls 18*a*, 18*b* and the opposing rolls 17*a*, 17*b*. The moisture from the pulp web 9 is absorbed during this process by the press felts 14*a*, 14*b*, 14*c* and 14*d*, which are also fed through the extended press nip together with the pulp web 9.

After mechanical dewatering, the pulp web 9 is transferred to the dryer fabric 21 in the dryer section 12 with the aid of the transfer roll 22. In the dryer section 12, the pulp web 9 is carried on the dryer fabric 21 in a meandering path over the drying cylinder 19 and the suction rolls 20, undergoing thermal drying at the same time.

Figure 3:
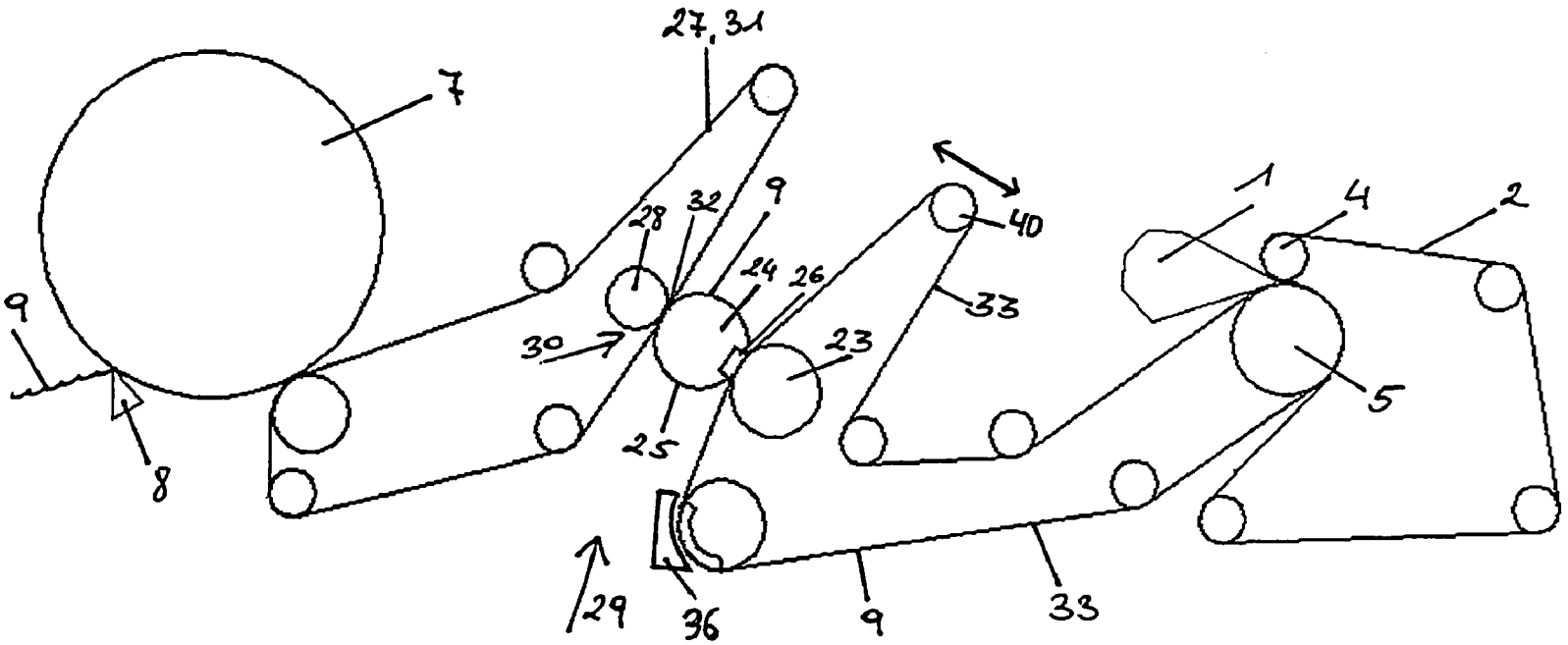
FIG. 3 shows a tissue machine with a press arrangement according to an embodiment of the invention.

FIG. 3 shows a tissue machine with a press arrangement according to the invention. It consists of an extended nip press unit 29, containing a press roll 24 with rotating pressing shell 25 and an opposing roll 23. An extended press nip 26 is formed between the press roll 24 and the opposing roll 23.

The press arrangement according to the invention operates as follows: The pulp web 9 is carried through the extended press nip 26 on the felt 33. In the extended press nip 26, the felt 33 absorbs moisture from the pulp web 9. In the present example, the felt 33 has a three-dimensional structure. The pulp web 9 can thus give way into the three-dimensional structure of the felt 33 during the pressing process. Thus, pressure is applied to specific points and not over an area. The felt 33 is separated from the pulp web 9 directly after the extended press nip 26 so that re-wetting is avoided.

After the extended press nip 26, the pulp web 9 no longer runs on the felt 33, but on the pressing shell 25. In a transfer zone 30, the pressing shell 25 passes the pulp web 9 on to a transfer element 31. In the present example, the transfer element 31 is a transfer fabric 27. On the other hand, the transfer element 31 can also be a roll that receives the pulp web 9 from the pressing shell 25. Suction can also be applied to this roll. Transfer of the pulp web to the transfer fabric 27 is assisted by the suction roll 28. An extended transfer nip 32 is formed between the suction roll 28 and the pressing roll 24.

In the present example, the transfer fabric 27 is permeable, but it is of course quite conceivable to use a non-permeable transfer fabric 27. The transfer fabric 27 can have either a smooth or a structured surface.

A further processing stage for the pulp web 9, namely either creping or stretching of the pulp web 9, can be carried out in the transfer zone 30. For creping, the surface of the transfer fabric 27 moves a little more slowly (lower relative speed) through the extended transfer nip 32 then the pressing shell 25, thus causing the pulp web 9 to be compressed or creped when it is passed on to the transfer fabric 27. Conversely, it is also possible to apply tensile forces to the pulp web 9 that result in the pulp web 9 being stretched. In order to achieve this, the transfer fabric 27 moves a little faster (higher relative speed) than the pressing shell. A rapidly moving transfer fabric 27 can have a positive effect on transfer of the pulp web.

The transfer fabric 27 should be conditioned in such a way that there is no or only very little wetting of the transfer fabric 27 as a result of the conditioning process. Thus, conditioning can be performed with compressed air, for example, or a compressed air lance. If water is used for conditioning, it must be guaranteed that the transfer fabric 27 is dried or dried by suction before it carries the pulp web 9 again. In order to stabilize the pulp web 9 on the transfer fabric 27, it can be advantageous if suction is applied continuously to the zone in which the transfer fabric 27 carries the pulp web 9.

After mechanical dewatering in the extended nip pressing unit 29, the pulp web 9 undergoes thermal drying on a Yankee cylinder 7. The dry pulp web 9 is scraped off the Yankee cylinder 7 with the aid of a doctor 8.

FIG. 3 also shows the adjustable felt roll 40. This adjustable felt roll 40 can be used to change the exit angle of the felt 33 from the long-nip pressing unit 29, for example by +/−15°. In this way it is possible to alter the contact area or the contact length of the felt 33 with the pulp web 9 after the extended press nip 26. The adjusting function of the felt roll 40 is indicated by a double arrow.

By enlarging this contact area or increasing this contact length, it is possible to ensure that the felt 33 runs on the pressing shell 25 for a little longer, with the pulp web 9 being clamped between the felt 33 and the pressing shell 25. This is beneficial to the pulp web 9 running together with the felt on the pressing shell 25. Any reduction in this contact area between the felt 33 and the pulp web 9 has the effect of enabling the felt 33 to be separated from the pulp web 9 particularly quickly after the extended pressing gap 26. In order to transfer a web tail strip, the largest possible contact area should be set at first so that the transfer tail runs securely on the pressing shell 25. When the pulp web 9 has been transferred and broadened to its full width, this contact area can be reduced again so that re-wetting of the pulp web 9 is kept to a minimum.

The pulp web 9 can be heated by means of the steam blow box 26.

Figure 4:
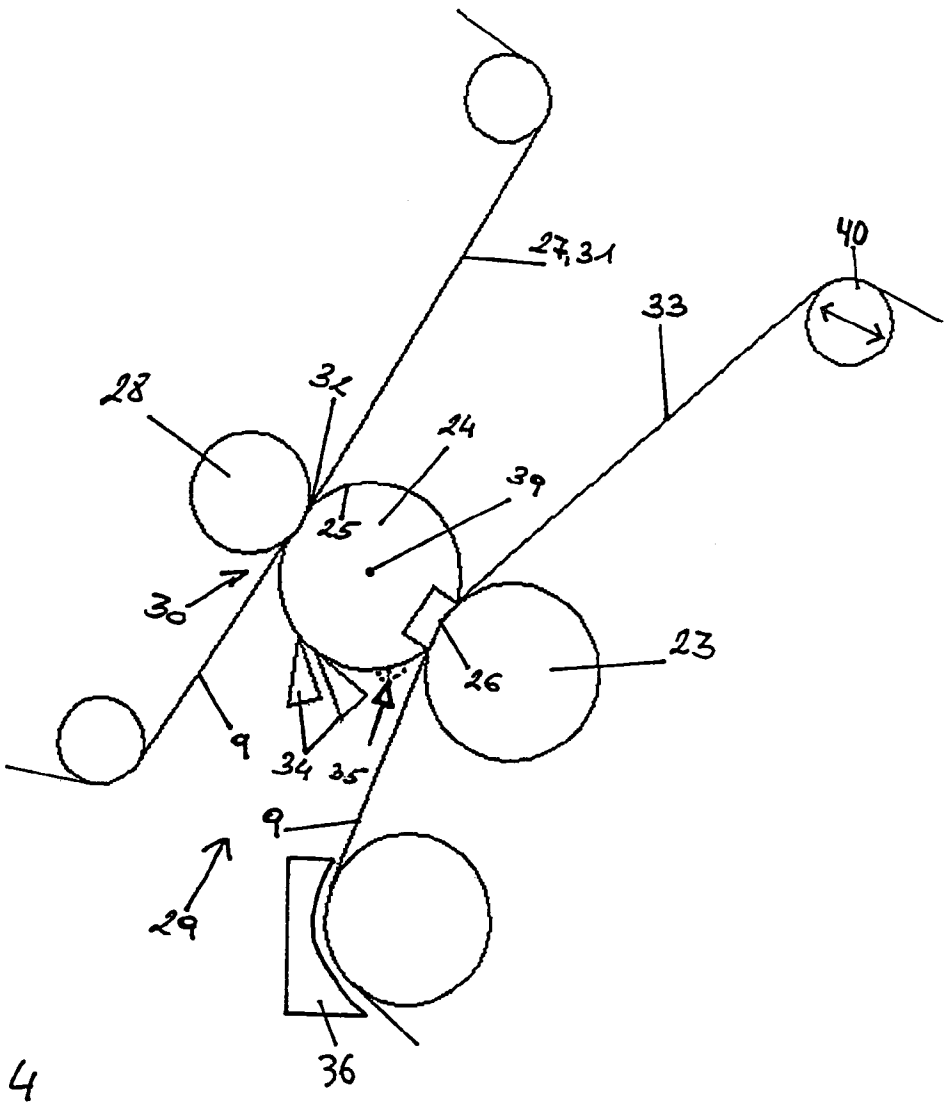
FIG. 4 shows a detailed view of the press arrangement of FIG. 3.

The extended nip pressing unit 29 is illustrated in more detail in FIG. 4. Here, the extended press nip 26 is shown clearly between the pressing shell 25 of the press roll 24 and the opposing roll 23. Similarly, the extended transfer nip 32 between the pressing shell 25 of the press roll 24 and the transfer fabric 27 is clearly visible. The press roll 24 is designed as a shoe press roll.

The extended transfer nip 32 is formed by the transfer fabric 27 being pressed against the pressing shell 25 by a roll, in the present case a roll to which suction is applied 28, where the pressing shell 25 largely follows the surface contour of the roll 28 in the transfer zone 30. The supporting and guide surface of the press roll 24 for the pressing shell 25 is formed in such a way in the transfer zone 30 that the pressing shell 25 is pressed in towards the central axis 39 of the press roll 24 in this zone, similar to the way in which this is effected in the extended press nip 26 in this area. By changing the press-down depth of the pressing shell 25, the length of the extended transfer nip 32 can be modified.

Overpressure is applied to the inside of the press roll 24 and serves to stabilize the rotating pressing shell 25. The face ends of the pressing roll 24 have suitable sealing end covers.

The opposing roll 23 of the extended nip pressing unit 29 can have grooves across the machine running direction in order to enhance dewatering. In this case, the grooves should be as narrow and as close to one another as possible as this can improve dewatering considerably. A groove width of less than 0.5 mm, particularly 0.4 mm, and a groove number of 5 or more per centimetre, viewed in the circumferential direction of the opposing roll 23, is desirable. The surface shell of the opposing roll 23 can be made of a hard elastomer or of metal; grooves can be cut into these materials very well.

In FIG. 4, cleaning devices 34 are provided for cleaning the pressing shell 25 after the transfer zone 30. The cleaning devices 34 can comprise one or several doctors, but may also include spray nozzles for a cleaning fluid, such as water or air. The cleaning device 34 can also be used for lifting off the web when transferring the pulp web 9. The pulp web 9 can thus be lifted off the pressing shell 25, scraped off for example, and fed to a pulper until web running has stabilized and the pulp web 9 can be fed to the dryer section.

In addition, a boundary surface adhesion mixture can be applied to the surface of the pressing shell 25 before the pressing shell 25 passes through the extended press nip 26. It can be applied using, for example, a spray bar 35 with showers that spray the boundary surface adhesion mixture onto the pressing shell 25. The surface adhesion of the pulp web 9 on the pressing shell 25 can be influenced with this process step. All fluids that are used for surface treatment of Yankee cylinders 7, as well as TAD chemicals, can be used for this purpose.

Dewatering of the pulp web 9 in the extended press nip 26 can also be improved by heating the pulp web 9, with the aid of a steam blow box 36 for example, arranged in front of the extended press nip 26. The adjustable felt roll 40 is also shown.

Figure 5:
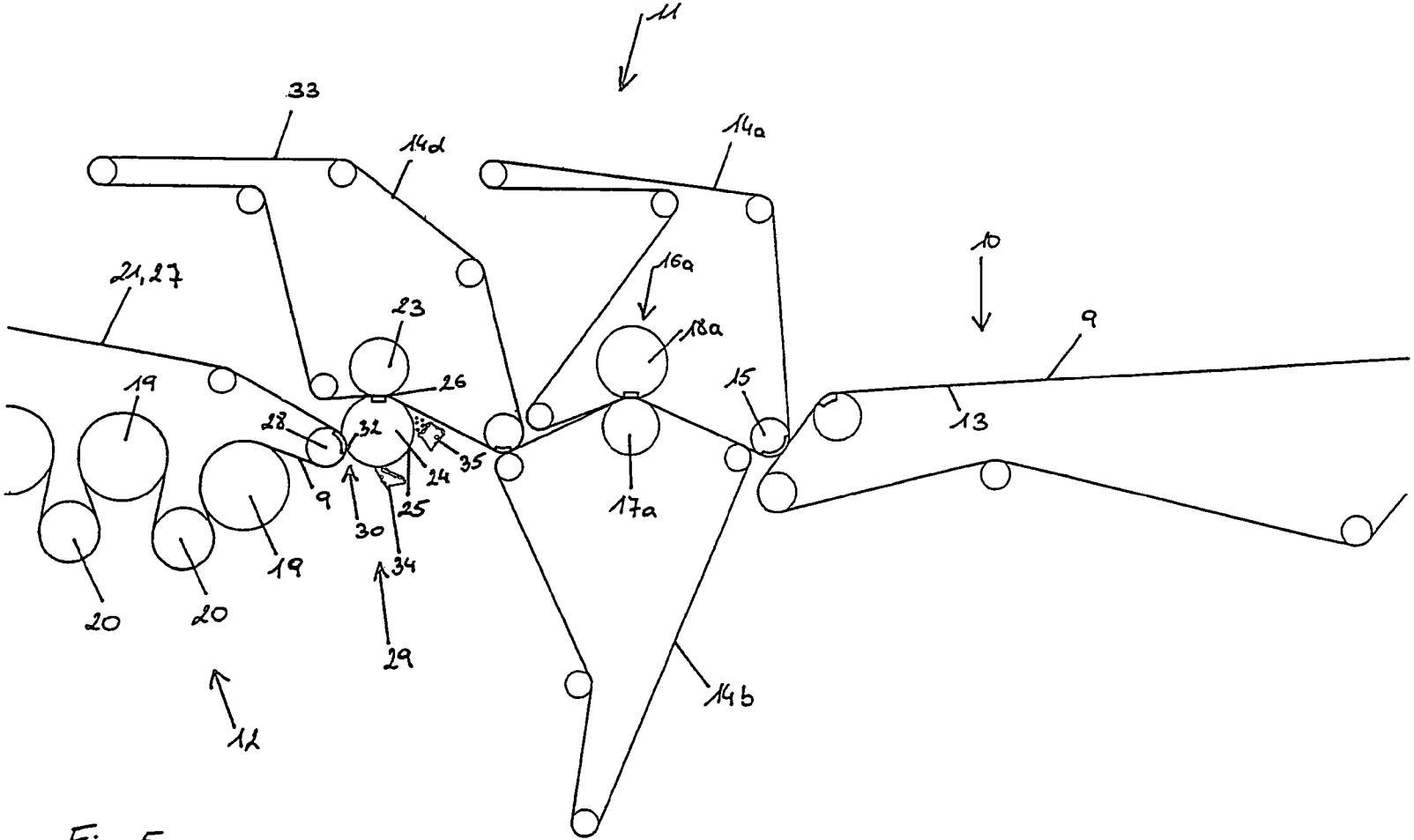
FIG. 5 shows a board machine with the press arrangement according to an embodiment of the invention.

FIG. 5 shows a board machine according to FIG. 2, however in this case the machine has an extended nip pressing unit 29 according to the invention. Here, the pulp web 9 is transferred directly from the pressing shell 25 to the dryer fabric 21 in the dryer section 12. Pulp web transfer in the extended transfer nip 32 is assisted by the roll 28, to which suction is applied. The length of the extended transfer nip 32 can be adjusted via the press-down depth into the press roll 25 by the roll 28, to which suction is applied.

A comparison with FIG. 2 shows that the pressing felt 14*c* is no longer required in the board machine according to the invention.

Figure 6:
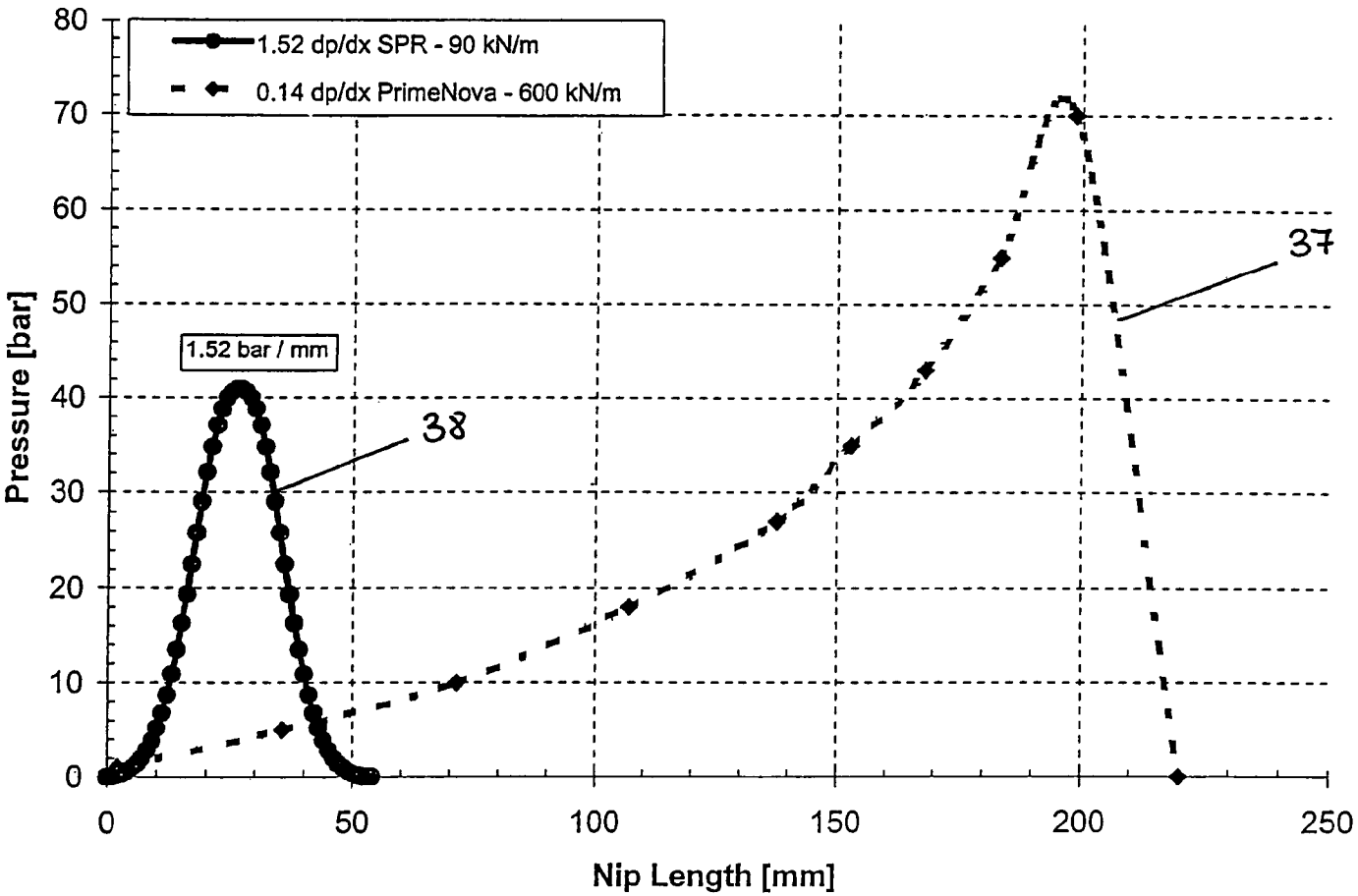
FIG. 6 shows the progression of a conventional and of an extended press profile.

In the extended press nip 26, a precisely defined pressing profile can act upon the pulp web 9. This type of pressing profile for an extended nip pressing unit 29 is shown as curve 37 in FIG. 6. Curve 38 shows a pressing profile of a pressing unit with standard rolls without an extended press nip 26. The adjustable felt roll 40 allows the contact area or contact length between felt 33 and pulp web 9 after the extended press nip 26 to be set here as well.

A steam blow box (not shown) can also be provided here in order to heat the pulp web 9 ahead of the extended press nip 26.

In the extended nip pressing unit 29, the pressing force applied to the pulp web 9 when it enters the extended press nip 26 should preferably be as low as possible. This pressing force then increases slowly, as shown clearly by curve 37 in FIG. 6. As a result of the gentle rise in pressing force, the specific volume (bulk) of the pulp web 9 is retained. As the dryness of the pulp web 9 rises, the pressing force for further dewatering can also be increased without having any substantial impact on the bulk. At a dry content of 40 to 50%, the pressing force reaches a maximum. At the end of the extended press nip 26, the pressing force should drop again as rapidly as possible as this will largely prevent or minimize the pulp web 9 being re-wetted by the felt 33.

The embodiments shown in the drawings are merely a preferred embodiment of the invention. The invention also includes other embodiments, where the transfer fabric 27 is wrapped partly round the pressing shell 25 in the transfer zone 30 for example. This also leads to formation of an extended transfer nip 32 for transfer of the pulp web 9.

The invention claimed is:

1. A press arrangement of a paper or board machine for treating a pulp web, comprising: an extended-nip pressing unit including a shoe press roll with a rotating flexible pressing shell and an opposing roll which together define an extended press nip for the pulp web; a felt on which the pulp web is carried to and through the extended press nip, wherein the web is carried directly on the rotating pressing shell of the shoe press roll; and a transfer element operatively associated with the press roll for supporting the pulp web after it leaves the extended press nip.

2. The press arrangement according to claim 1, wherein the transfer element is a transfer fabric.

3. The press arrangement according to claim 2, wherein the transfer fabric is structured.

4. The press arrangement according to claim 2, wherein the transfer fabric is unstructured.

5. The press arrangement according to claim 2, wherein the transfer fabric is permeable.

6. The press arrangement according to claim 1, wherein the transfer element is a roll.

7. The press arrangement according to claim 1, including an extended transfer nip for pulp web transfer between the pressing shell and the transfer element.

8. The press arrangement according to claim 7, wherein the extended transfer nip between pressing shell and transfer element has an adjustable length.

9. The press arrangement according to claim 7, including a device for applying suction to the extended transfer nip between pressing shell and transfer element.

10. Press arrangement according to claim 1, including a felt deflection roll, wherein the felt roll around which the felt is deflected after the extended press nip can be set in such a way that the contact area after the extended press nip between the felt and the pulp web is adjustable.

* * * * *